US008899775B2

(12) United States Patent
Maxik et al.

(10) Patent No.: US 8,899,775 B2
(45) Date of Patent: Dec. 2, 2014

(54) LOW-ANGLE THOROUGHFARE SURFACE LIGHTING DEVICE

(71) Applicant: Lighting Science Group Corporation, Satellite Beach, FL (US)

(72) Inventors: Fredric S. Maxik, Indialantic, FL (US); David E. Bartine, Cocoa, FL (US); Robert R. Soler, Cocoa Beach, FL (US); Mark Andrew Oostdyk, Cape Canaveral, FL (US); Addy S. Widjaja, Palm Bay, FL (US); Ran Zhou, Melbourne, FL (US); James Lynn Schellack, Cocoa Beach, FL (US)

(73) Assignee: Lighting Science Group Corporation, Satellite Beach, FL (US)

( * ) Notice: Subject to any disclaimer, the term of this patent is extended or adjusted under 35 U.S.C. 154(b) by 0 days.

(21) Appl. No.: 13/839,131

(22) Filed: Mar. 15, 2013

(65) Prior Publication Data

US 2014/0268695 A1 Sep. 18, 2014

(51) Int. Cl.

| | |
|---|---|
| ***E01F 9/00*** | (2006.01) |
| ***E01F 9/04*** | (2006.01) |
| ***F21V 7/10*** | (2006.01) |
| ***F21V 29/00*** | (2006.01) |

(52) U.S. Cl.
CPC .. *F21V 7/10* (2013.01); *F21V 29/22* (2013.01)
USPC ..... 362/153.1; 362/153; 340/815.49; 340/815.73; 404/12; 404/14

(58) Field of Classification Search
USPC ..... 362/153, 153.1; 404/9–16; 340/815.49, 340/815.73, 815.74
See application file for complete search history.

(56) References Cited

U.S. PATENT DOCUMENTS

| | | | |
|---|---|---|---|
| 3,332,327 | A | 7/1967 | Heenan |
| 3,409,344 | A | 11/1968 | Balint et al. |
| 3,984,175 | A | 10/1976 | Suhr et al. |

(Continued)

FOREIGN PATENT DOCUMENTS

| | | |
|---|---|---|
| DE | 202005013164 | 11/2005 |
| DE | 102005059362 | 9/2006 |

(Continued)

OTHER PUBLICATIONS

U.S. Appl. No. 13/739,054, filed Jan. 2013, Maxik et al.

(Continued)

*Primary Examiner* — Mariceli Santiago
(74) *Attorney, Agent, or Firm* — Mark R. Malek; Zies Widerman & Malek

(57) ABSTRACT

A lighting device includes a housing attached to a thoroughfare surface. The housing may have a top surface, a proximal face, a distal face, and first and second opposing sidewalls extending between the proximal face and the distal face and extending downwardly from the top surface. The lighting device may further include a first primary optic that may be carried by the housing adjacent the first sidewall that may define a first optical chamber. The lighting device may also further include a first light source that may be positioned within the first optical chamber and may be carried by the housing adjacent the first sidewall. The first sidewall may taper in a direction of the distal face. The first primary optic may be configured to direct light outward and in a direction of the taper in the first sidewall.

25 Claims, 14 Drawing Sheets

(56) References Cited

U.S. PATENT DOCUMENTS 4,668,120 A * 5/1987 Roberts ..... 404/12
5,057,908 A 10/1991 Weber
5,061,114 A 10/1991 Hedgewick
5,449,244 A 9/1995 Sandino
5,523,878 A 6/1996 Wallace et al.
5,704,701 A 1/1998 Kavanagh et al.
5,963,192 A 10/1999 Wong et al.
5,997,150 A 12/1999 Anderson
6,140,646 A 10/2000 Busta et al.
6,149,283 A 11/2000 Conway et al.
6,150,774 A 11/2000 Mueller et al.
6,250,774 B1 6/2001 Begemann et al.
6,341,876 B1 1/2002 Moss et al.
6,356,700 B1 3/2002 Strobl
6,561,656 B1 5/2003 Kojima et al.
6,594,090 B2 7/2003 Kruschwitz et al.
6,598,996 B1 7/2003 Lodhie
6,601,984 B2 8/2003 Yamamoto et al.
6,624,845 B2 9/2003 Lloyd et al.
6,676,279 B1 1/2004 Hubbell et al.
6,705,744 B2 3/2004 Hubbell et al.
6,707,611 B2 3/2004 Gardiner et al.
6,733,135 B2 5/2004 Dho
6,767,111 B1 7/2004 Lai
6,774,916 B2 8/2004 Pettitt et al.
6,811,258 B1 11/2004 Grant
6,817,735 B2 11/2004 Shimizu et al.
6,870,523 B1 3/2005 Ben-David et al.
6,871,982 B2 3/2005 Holman et al.
6,906,852 B1 6/2005 Russell
6,967,761 B2 11/2005 Starkweather et al.
6,974,713 B2 12/2005 Patel et al.
7,014,336 B1 3/2006 Ducharme et al.
7,042,623 B1 5/2006 Huibers et al.
7,070,281 B2 7/2006 Kato
7,072,096 B2 7/2006 Holman et al.
7,075,707 B1 7/2006 Rapaport et al.
7,083,304 B2 8/2006 Rhoads
7,093,956 B2 8/2006 Miller et al.
7,095,056 B2 8/2006 Vitta et al.
7,178,941 B2 2/2007 Roberge et al.
7,184,201 B2 2/2007 Duncan
7,246,923 B2 7/2007 Conner
7,255,469 B2 8/2007 Wheatley et al.
7,261,453 B2 8/2007 Morejon et al.
7,289,090 B2 10/2007 Morgan
7,300,177 B2 11/2007 Conner
7,303,291 B2 12/2007 Ikeda et al.
7,325,956 B2 2/2008 Morejon et al.
7,342,658 B2 3/2008 Kowarz et al.
7,344,279 B2 3/2008 Mueller et al.
7,349,095 B2 3/2008 Kurosaki
7,353,859 B2 4/2008 Stevanovic et al.
7,382,091 B2 6/2008 Chen
7,382,632 B2 6/2008 Alo et al.
7,400,439 B2 7/2008 Holman
7,427,146 B2 9/2008 Conner
7,429,983 B2 9/2008 Islam
7,434,946 B2 10/2008 Huibers
7,438,443 B2 10/2008 Tatsuno et al.
7,476,016 B2 1/2009 Kurihara
7,520,642 B2 4/2009 Holman et al.
7,530,708 B2 5/2009 Park
7,537,347 B2 5/2009 Dewald
7,540,616 B2 6/2009 Conner
7,545,569 B2 6/2009 Cassarly
7,556,406 B2 7/2009 Petroski et al.
7,598,686 B2 10/2009 Lys et al.
7,605,971 B2 10/2009 Ishii et al.
7,626,755 B2 12/2009 Furuya et al.
7,628,508 B2 12/2009 Kita et al.
7,677,736 B2 3/2010 Kasazumi et al.
7,684,007 B2 3/2010 Hull et al.
7,703,943 B2 4/2010 Li et al.
7,709,811 B2 5/2010 Conner
7,719,766 B2 5/2010 Grasser et al.
7,731,383 B2 6/2010 Myer
7,759,854 B2 7/2010 Miller et al.
7,766,490 B2 8/2010 Harbers et al.
7,777,166 B2 8/2010 Roberts
7,819,556 B2 10/2010 Heffington et al.
7,828,453 B2 11/2010 Tran et al.
7,828,465 B2 11/2010 Roberge et al.
7,832,878 B2 11/2010 Brukilacchio et al.
7,834,867 B2 11/2010 Sprague et al.
7,835,056 B2 11/2010 Doucet et al.
7,845,823 B2 12/2010 Mueller et al.
7,850,321 B2 12/2010 Wang et al.
7,850,335 B2 12/2010 Hsu et al.
7,863,829 B2 1/2011 Sayers et al.
7,889,430 B2 2/2011 El-Ghoroury et al.
7,909,479 B2 3/2011 Rooymans
7,928,565 B2 4/2011 Brunschwiler et al.
7,942,537 B2 5/2011 Krijn et al.
7,959,320 B2 6/2011 Mueller et al.
7,972,030 B2 7/2011 Li
7,976,205 B2 7/2011 Grotsch et al.
8,016,443 B2 9/2011 Falicoff et al.
8,021,021 B2 9/2011 Paolini
8,047,660 B2 11/2011 Penn et al.
8,061,857 B2 11/2011 Liu et al.
8,061,869 B2 11/2011 Lo
8,070,302 B2 12/2011 Hatanaka et al.
8,070,324 B2 12/2011 Kornitz et al.
8,083,364 B2 12/2011 Allen
8,096,668 B2 1/2012 Abu-Ageel
8,096,685 B2 1/2012 Lu et al.
8,100,552 B2 1/2012 Spero
8,118,456 B2 2/2012 Reed et al.
8,130,099 B2 3/2012 Steinel et al.
8,136,969 B2 3/2012 Burkett et al.
8,143,811 B2 3/2012 Shloush et al.
8,246,194 B2 8/2012 Lai
8,297,783 B2 10/2012 Kim
8,308,318 B2 11/2012 Maxik
8,322,889 B2 12/2012 Petroski
8,331,099 B2 12/2012 Geissler et al.
8,337,029 B2 12/2012 Li
8,337,063 B2 12/2012 Nagasawa et al.
8,427,590 B2 4/2013 Raring et al.
8,475,002 B2 7/2013 Maxik et al.
8,491,153 B2 7/2013 Maxik et al.
2004/0052076 A1 3/2004 Mueller et al.
2004/0175232 A1* 9/2004 Hunter et al. ..... 404/16
2005/0025570 A1* 2/2005 Snagel ..... 404/16
2005/0238425 A1* 10/2005 Safar ..... 404/16
2005/0265023 A1 12/2005 Scholl
2006/0002108 A1 1/2006 Ouderkirk et al.
2006/0002110 A1 1/2006 Dowling et al.
2006/0056169 A1 3/2006 Lodhie et al.
2006/0103777 A1 5/2006 Ko et al.
2006/0149607 A1 7/2006 Sayers et al.
2006/0164005 A1 7/2006 Sun
2006/0164607 A1 7/2006 Morejon et al.
2006/0285193 A1 12/2006 Kimura et al.
2007/0013871 A1 1/2007 Marshall et al.
2007/0081339 A1 4/2007 Chung et al.
2007/0188847 A1 8/2007 McDonald et al.
2007/0241340 A1 10/2007 Pan
2008/0043464 A1 2/2008 Ashdown
2008/0055065 A1 3/2008 Feldmeier
2008/0143973 A1 6/2008 Wu
2008/0198572 A1 8/2008 Medendorp
2008/0232084 A1 9/2008 Kon
2009/0059099 A1 3/2009 Linkov et al.
2009/0059585 A1 3/2009 Chen et al.
2009/0128781 A1 5/2009 Li
2009/0232683 A1 9/2009 Hirata et al.
2010/0006762 A1 1/2010 Yoshida et al.
2010/0039704 A1 2/2010 Hayashi et al.
2010/0098488 A1 4/2010 Huck et al.
2010/0103389 A1 4/2010 McVea et al.

(56) References Cited

U.S. PATENT DOCUMENTS

| | | | |
|---|---|---|---|
| 2010/0202129 | A1 | 8/2010 | Abu-Ageel |
| 2010/0231863 | A1 | 9/2010 | Hikmet et al. |
| 2010/0244700 | A1 | 9/2010 | Chong et al. |
| 2010/0315320 | A1 | 12/2010 | Yoshida |
| 2010/0320928 | A1 | 12/2010 | Kaihotsu et al. |
| 2010/0321641 | A1 | 12/2010 | Van Der Lubbe |
| 2011/0242821 | A1 | 10/2011 | Pan |
| 2012/0218774 | A1 | 8/2012 | Livingston |
| 2012/0285667 | A1 | 11/2012 | Maxik et al. |

FOREIGN PATENT DOCUMENTS

| | | |
|---|---|---|
| EP | 2410240 | 1/2012 |
| WO | WO 2005072279 | 8/2005 |
| WO | WO 2007/069185 | 6/2007 |
| WO | WO 2008/019481 | 2/2008 |
| WO | WO 2009/040703 | 4/2009 |

OTHER PUBLICATIONS

Arthur P. Fraas, Heat Exchanger Design, 1989, p. 60, John Wiley & Sons, Inc., Canada.

H. A El-Shaikh, S. V. Garimella, "Enhancement of Air Jet Impingement Heat Transfer using Pin-Fin Heat Sinks", D IEEE Transactions on Components and Packaging Technology, Jun. 2000, vol. 23, No. 2.

J. Y. San, C. H. Huang, M. H, Shu, "Impingement cooling of a confined circular air jet", In t. J. Heat Mass Transf. , 1997. pp. 1355-1364, vol. 40.

N. T. Obot, W. J. Douglas, A S. Mujumdar, "Effect of Semi-confinement on Impingement Heat Transfer", Proc. 7th Int. Heat Transf. Conf., 1982, pp. 1355-1364. vol. 3.

S. A Solovitz, L. D. Stevanovic, R. A Beaupre, "Microchannels Take Heatsinks to the Next Level", Power Electronics Technology, Nov. 2006.

Yongmann M. Chung, Kai H. Luo, "Unsteady Heat Transfer Analysis of an Impinging Jet", Journal of Heat Transfer—Transactions of the ASME, Dec. 2002, pp. 1039-1048, vol. 124, No. 6.

* cited by examiner

LOW-ANGLE THOROUGHFARE SURFACE LIGHTING DEVICE

RELATED APPLICATIONS

This application is related to U.S. patent application Ser. No. 13/739,054 titled Luminaire with Prismatic Optic filed Jan. 11, 2013 which, in turn, claims the benefit under 35 U.S.C. §119(e) of U.S. Provisional Patent Application Ser. No. 61/642,205 titled Luminaire with Prismatic Optic filed May 3, 2012, the entire contents of each of which are incorporated herein by reference. This application is also related to U.S. patent application Ser. No. 13/465,921 entitled Sustainable Outdoor Lighting System and Associated Methods filed on May 7, 2012, the entire contents of which are incorporated herein by reference, which is in turn a continuation in part of U.S. patent application Ser. No. 13/329,803 entitled Sustainable Outdoor Lighting System filed on Dec. 19, 2011, the entire contents of which are incorporated herein by reference, which is in turn a continuation application of U.S. patent application Ser. No. 12/434,417 titled Sustainable Outdoor Lighting System filed on May 1, 2009, the entire contents of which are incorporated herein. This application is also related to U.S. patent application Ser. No. 13/107,782 titled Sound Baffling Cooling System for LED Thermal Management and Associated Methods filed May 13, 2011, the entire contents of which are incorporated herein.

FIELD OF THE INVENTION

The present invention relates to the fields of lighting devices and, more specifically, to roadway reflectors and surface lighting devices.

BACKGROUND OF THE INVENTION

Lighting is used to illuminate roadways, bikeways, walkways, sidewalks, pathways, bridges, ramps, tunnels, curbs, parking lots, driveways, roadway barriers, drainage structures, utility structures, and many other objects. The lighting devices commonly used for illuminating roadway or other similar surfaces are overhead lights, particularly overhead street lamps. Overhead lighting devices commonly provide inefficient lighting and the majority of light emitted is absorbed by the roadway, structure, or other object and fails to efficiently illuminate the intended object(s).

Furthermore, lighting technologies such as light-emitting diodes (LEDs) offer significant advantages over incandescent, fluorescent, and high pressure sodium lamps that are often used in roadway overhead lights. These advantages include, but are not limited to, better lighting quality, longer operating life, and lower energy consumption. The majority of lighting devices used for roadways, bikeways, walkways, sidewalks, pathways, bridges, ramps, tunnels, curbs, parking lots, driveways, roadway barriers, drainage structures, utility structures, and other similar objects are often inefficient and need repair or replacement often. Although the use of LED lighting devices for overhead lighting presents significant advantages over traditional roadway lighting that uses incandescent or fluorescent lights, absorption of light may sometimes require the use of larger LEDs and/or an increased amount of LEDs to provide sufficient illumination. Therefore, there is a need for an improved and more efficient lighting system where the majority of the amount of light emitted is not absorbed.

Roadway reflectors come in several standard shapes, such as, for example rectangular or circular. Roadway reflectors have not been designed with the intent to illuminate other objects, such as roadways, bikeways, walkways, sidewalks, pathways, bridges, ramps, tunnels, curbs, parking lots, driveways, roadway barriers, drainage structures, utility structures, and other similar objects. Therefore, there is a need for an improved roadway reflector that also illuminates adjacent surfaces without emitting light into oncoming traffic, thereby illuminating only the surfaces of the intended objects.

U.S. Pat. No. 3,332,327 to Heenan, U.S. Pat. No. 3,409,344 to Balint et al., U.S. Pat. No. 3,984,175 to Suhr et al., and U.S. Pat. No. 5,061,114 to Hedgewick disclose reflective roadway markers having a shell-like housing and a reflective portion of light transmitting material carried by the housing. The marker in all of these patents may not have any light source or power generating elements and may not have sidewalls that are slanted, curved, partially slanted, or partially curved.

U.S. patent application Ser. No. 12/502,232 to Huck et al. discloses a solar powered road marker light that is self-powered and self-illuminating with relatively low energy consumption. The road marker light is installed on road dividers, markers, signs, traffic barriers, traffic control devices, etc. The road marker light may not be installed on a thoroughfare surface, such as a roadway, pathway, sidewalk, curb, or other similar surface. Further, the road marker light may only illuminate the housing of the road marker light and does not illuminate the thoroughfare surface.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

In view of the foregoing, it is therefore an object of the present invention to provide an improved LED-based lighting device for use in a space-limited lighting enclosure, such as a roadway reflector. It is also an object of the present invention to provide a lighting device that advantageously allows for emission of light towards the surface(s) of the surrounding area, such as the roadway surface, whereby the light emitted is less absorbed than other means existing in the art, such as overhead lights. It is further an object of the present invention to advantageously provide a lighting device that is easy to install. The present invention also advantageously provides a lighting device that includes its own power system, such as a photovoltaic power system.

With the above in mind, the objects, features and advantages according to an embodiment of the present invention are provided by a lighting device that may include a housing that can be attached to a thoroughfare surface. The housing may also include a first primary optic and a first light source. The housing may have a top surface, a proximal face, a distal face, a bottom member, and a first and second opposing sidewalls that may extend between the proximal face and the distal face. The first and second opposing sidewalls may extend downwardly from the top surface. The first primary optic may be carried by the housing adjacent the first sidewall which may define a first optical chamber. The first light source may be positioned within the first optical chamber and may be carried by the housing adjacent the first sidewall.

The first sidewall may taper in a direction of the distal face and the first primary optic may direct light outward and in a direction of the taper in the first sidewall. Light emitted from the first light source may be directed through the first primary optic within a range from about parallel to a face of the first primary optic in the direction of the proximal face to skew from the face of the first primary optic to about perpendicular to the face of the first primary optic.

The lighting device may further include a second primary optic and a second light source. The second primary optic may be carried by the housing adjacent the second sidewall that may define a second optical chamber. The second light source may be positioned within the second optical chamber and may be carried by the housing adjacent the second sidewall. The second sidewall may taper in a direction of either the proximal face or the distal face. The second primary optic may direct light outward and in the direction of the taper in the second sidewall. Light emitted from the second light source may be directed through the second primary optic within a range from about parallel to a face of the second primary optic in the direction of the proximal face to skew from the face of the second primary optic to about perpendicular to the face of the second primary optic.

The lighting device may further include a first and second secondary optic and an ambient light sensor that may be carried by the housing. The ambient light sensor may be a photodiode device, a phototransistor device, a photovoltaic device, or a photomultiplier device. The lighting device may further include a power generating element that may be carried by the housing and may be a photovoltaic device, a piezoelectric device, or a thermoelectric device.

The lighting device may also further include a driver circuit and a battery. The driver circuit may be electrically coupled to the power generating element, the first light source, and/or a microcontroller. The battery may be electrically coupled to the power generating element. The power generating element may produce electrical power that may be stored by a battery. The first light source or the microcontroller may operate using electrical power drawn from the driver circuit.

As mentioned above, the lighting device may further include a photovoltaic device. The housing may further comprise a top inner surface that may cooperate with the photovoltaic device to define a photovoltaic device chamber. The lighting device may be electrically coupled to an external power source. At least one of the first and second sidewalls may be curved, slanted, partially curved, or partially slanted.

The first optical chamber may comprise a reflective layer. The reflective layer may be a color-converting reflective layer. The first primary optic may comprise a color-converting layer.

The lighting device may further comprise a communication device, the microcontroller, and/or a traffic sensor. The traffic sensor may generate data regarding traffic in the environment surrounding the lighting device. The communication device may transmit the data generated by the traffic sensor across a network.

The first light source may include a light emitting diode (LED). The first primary optic may collimate, diffuse, direct, or refract light. The lighting device may further include a reflective member that may be positioned on the proximal face and/or the distal face. The lighting device may further include a heat sink that may be carried by the housing and may include a plurality of fins and a post that may be carried by either the housing or the bottom member. The post may include the heat sink, the battery, and/or the circuitry.

DETAILED DESCRIPTION OF THE PREFERRED EMBODIMENT

Figure 1A:
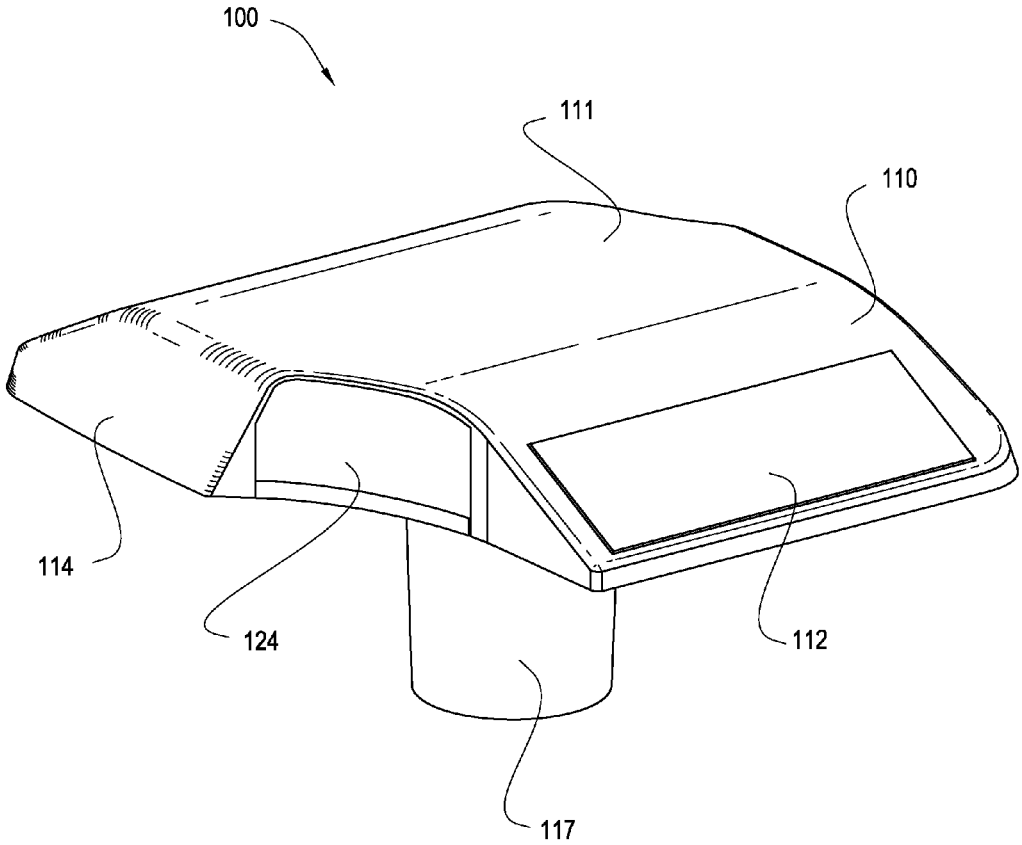
FIG. 1A is a right side perspective view of a lighting device according to an embodiment of the present invention.

The present invention will now be described fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art will realize that the following embodiments of the present invention are only illustrative and are not intended to be limiting in any way. Other embodiments of the present invention will readily suggest themselves to such skilled persons having the benefit of this disclosure. Additionally, like numbers refer to like elements throughout.

Throughout this disclosure, the present invention may be referred to as relating to luminaires, digital lighting, and light-emitting diodes (LEDs). Those skilled in the art will appreciate that this terminology is only illustrative and does not affect the scope of the invention. For instance, the present invention may just as easily relate to lasers or other digital lighting technologies. Additionally, a person of skill in the art will appreciate that the use of LEDs within this disclosure is not intended to be limited to any specific form of LED, and should be read to apply to light emitting semiconductors in general. Accordingly, skilled artisans should not view the following disclosure as limited to any particular light emitting semiconductor device, and should read the following disclosure broadly with respect to the same.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention. Those skilled in the art will appreciate that many variations and alterations to the descriptions contained herein are within the scope of the invention.

Referring to FIGS. 1-11, a lighting device 100 according to an embodiment of the present invention, is now described in detail. Throughout this disclosure, the present invention may be referred to as a lighting device 100, a lighting system, an LED lighting system, a lamp system, a lamp, a luminaire, a device, a system, a product, and a method. Those skilled in the art will appreciate that this terminology is only illustrative and does not affect the scope of the invention.

According to embodiments of the present invention, as depicted, for example, in FIGS. 1-11, the lighting device 100 may include a housing 110, a first primary optic 120, and a first light source 127. The lighting device 100 may further include a second primary optic 121, a second light source 128, a first and second secondary optics 124, 125, an ambient light sensor 130, a power generating element 131, a driver circuit 141, a battery 145, a photovoltaic device 132, a communication device 143, a microcontroller 142, a traffic sensor 144, a reflective member 150, and a heat sink 160. The housing 110 may be attached to a thoroughfare surface and may include a top surface 111, a proximal face 112, a distal face 113, and first and second opposing sidewalls 114, 115. The housing 110 may further include a top inner surface 133 that may cooperate with the photovoltaic device 132 to define a photovoltaic device chamber 134. The housing 110 may additionally include a bottom member 116. The bottom member 116 may include a post 117. The post 117 may include a circuitry 140 and/or the heat sink 160.

The thoroughfare surface may be any surface to which the lighting device 100 may be attached to or carried by. The thoroughfare may be any object or structure that has a surface, particularly those that allow vehicular, air, bicycle, pedestrian, or other traffic. For example, a thoroughfare surface may be a roadway, a bikeway, a walkway, a sidewalk, a pathway, a bridge, a ramp, a tunnel, a curb, a parking lot, a driveway, a roadway barrier, a drainage structure, a utility structure, or any other similar object or structure. Those skilled in the art will appreciate that this terminology is only illustrative and does not affect the scope of the invention.

Figure 9:
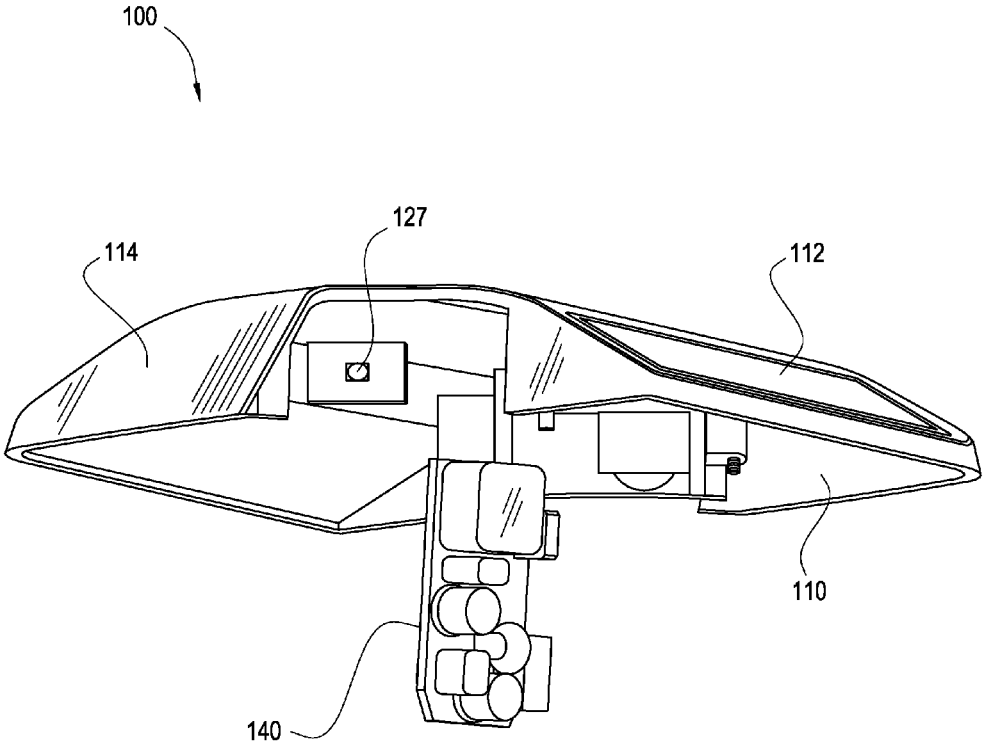
FIG. 9 is a bottom perspective view of a portion of the lighting device illustrated in FIG. 1A.
Figure 11:
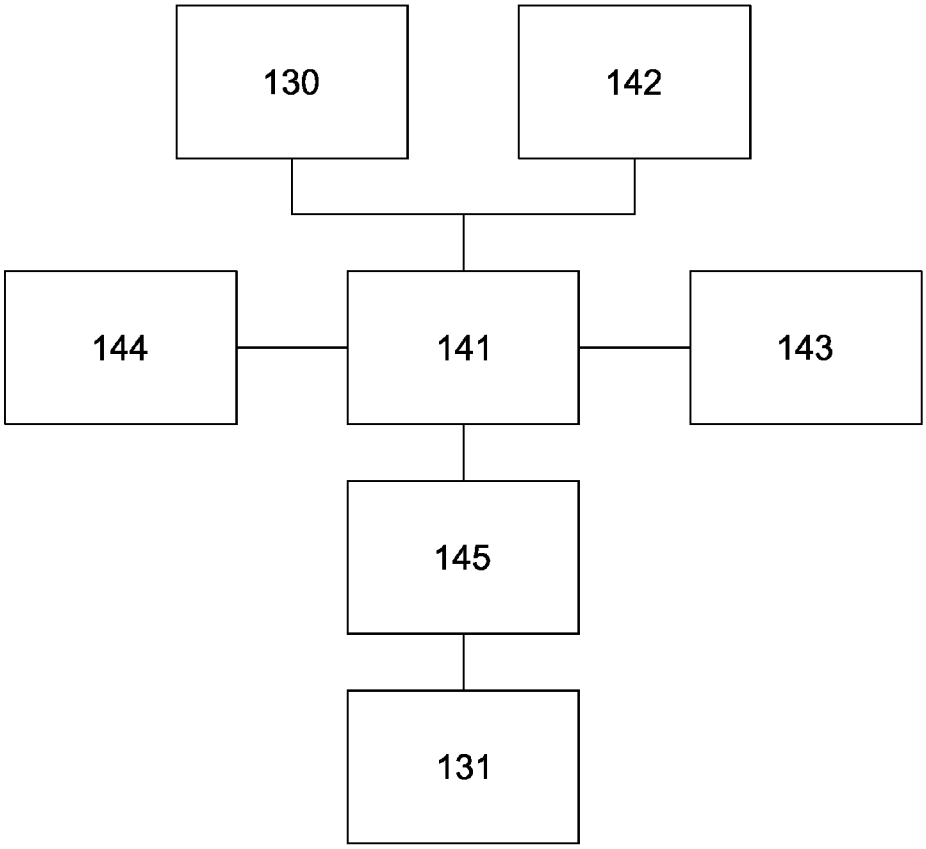
FIG. 11 is a schematic view of a portion of the lighting device illustrated in FIG. 1A.

Referring to FIGS. 9 and 11, the circuitry 140 may include the driver circuit 141, the microcontroller 142, the communication device 143, and/or the traffic sensor 144. The circuitry 140 may be electrically coupled to the first and second light source 127, 128, the ambient sensor 130, the power generating element 131, the photovoltaic device 132, and/or the battery 145. Further, those skilled in the art will readily appreciate that the driver circuit 141, the microcontroller 142, the communication device 143, the traffic sensor 144, the battery 145, and/or the external power source may be electrically coupled to one another in any number of combinations.

Referring to FIGS. 1-10, the first and second opposing sidewalls 114, 115 may extend between the proximal face 112 and the distal face 113 and may extend downwardly from the top surface 111. The first primary optic 120 may be carried by the housing 110 adjacent the first sidewall 114 and may define a first optical chamber 122. The first light source 127 may be positioned within the first optical chamber 122 and may be carried by the housing 110 adjacent the first sidewall 114. The second primary optic 121 may be carried by the housing 110 adjacent the second sidewall 115 and may define a second optical chamber 123. The second light source 128 may be positioned within the second optical chamber 123 and may be carried by the housing 110 adjacent the second sidewall 115. The first optical chamber 122 and/or the second optical chamber 123 may include a reflective layer 126. The reflective layer 126 may be a color-converting reflective layer. The first primary optic 120 and/or the second primary optic 121 may include a color-converting layer. The first secondary optic 124 and/or the second secondary optic 125 may include a color-converting layer. Further, the first and second secondary optics 124, 125, the ambient light sensor 130, and the power generating element 131 may be carried by the housing 110.

Figure 2A:
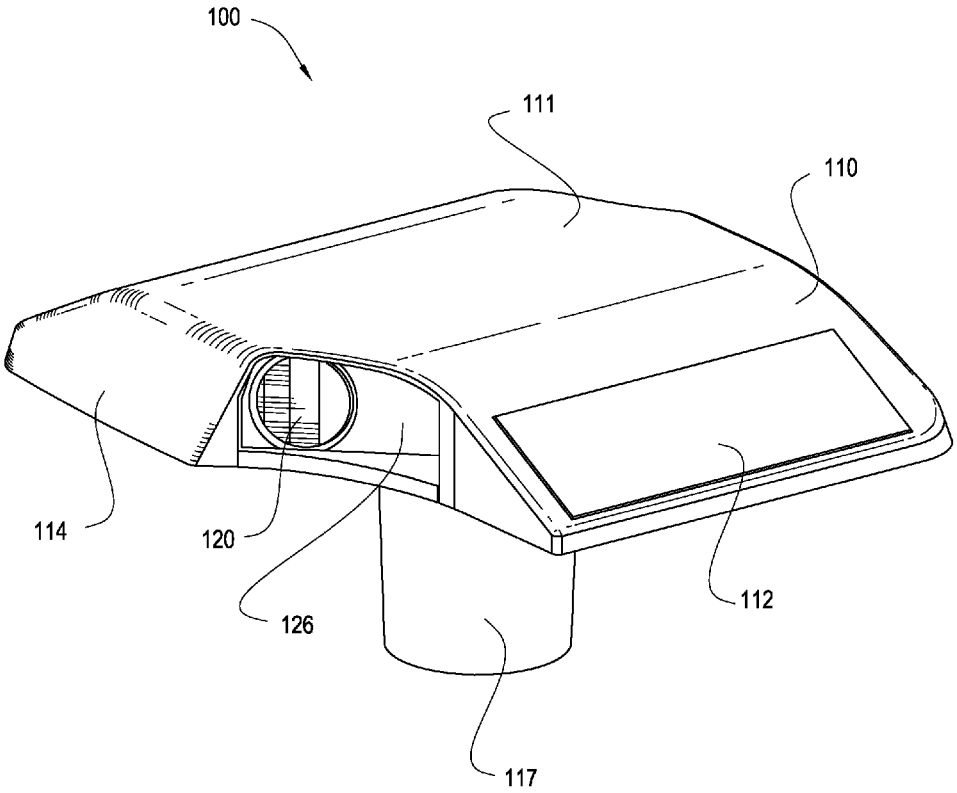
FIG. 2A is a right side perspective view of a portion of the lighting device illustrated in FIG. 1A.
Figure 2B:
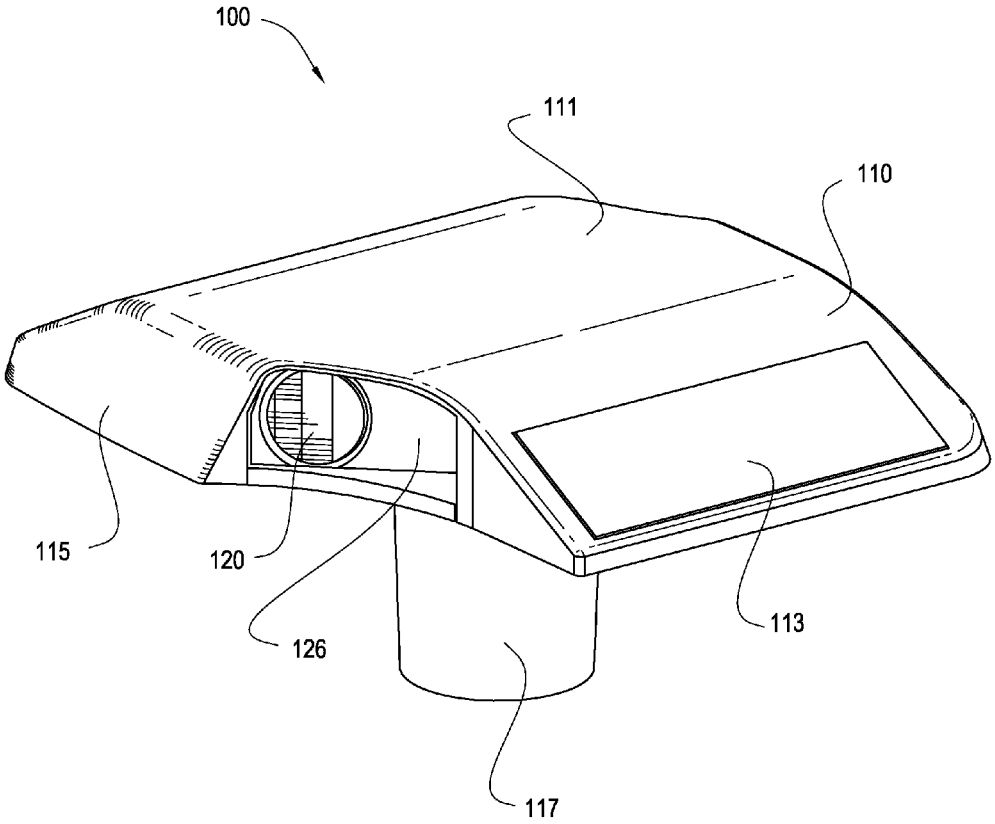
FIG. 2B is a left side perspective view of a portion of the lighting device illustrated in FIG. 1A.

Referring to FIGS. 2A and 2B, the reflective layer 126 may reflect light incident thereupon. The reflective layer 126 preferably has a reflection coefficient of at least about 0.1. Those skilled in the art will appreciate, however, that the measurement of the amplitude of the reflected waves versus the amplitude of the incident waves may be shown by the reflection coefficient which may also be anywhere between 0.10 and about 1. In one embodiment, the reflective layer 126 may act as a substrate and have a layer of reflective paint applied thereto. The reflective paint may advantageously enhance illumination provided by the first light source 127 and/or the second light source 128 by causing enhanced reflection of the light prior to reaching the first secondary optic 124 and/or the second secondary optic 125. In another embodiment, the reflective layer 126 may have a reflective liner applied thereto. Similarly, the reflective liner may be readily provided by any type of reflective liner which may be known in the art.

Referring now to FIGS. 1-9, the first and second primary optics 120, 121 and/or the first and second secondary optics 124, 125 may attach to either the housing 110, the first and second opposing sidewalls 114, 115, and/or the first and second optical chambers 122, 123. Specifically, the first and second primary optics 120, 121 and the first and second secondary optics 124, 125 may form an interference fit with the housing 110, the first and second opposing sidewalls 114, 115, and/or the first and second optical chambers 122, 123. The interference fit preferably provides sufficient strength to carry the first and second primary optics 120, 121 and/or the first and second secondary optics 124, 125. Optionally, the first and second primary optics 120, 121 and/or the first and second secondary optics 124, 125 may be attached to the housing 110, the first and second opposing sidewalls 114, 115, and/or the first and second optical chambers 122, 123 through the use of glue, adhesives, fasteners, screws, bolts, welding, or any other means known in the art.

The first sidewall 114 may taper in a direction of the proximal face 112 or the distal face 113. The first primary optic 120 may direct light outward and in a direction of the taper in the first sidewall 114. For example, the first primary optic 120 may direct light outward and in a direction of the proximal face 112 or the distal face 113 so as to avoid emitting light in a direction of oncoming traffic. The light emitted may be directed so that it is angled at least one degree away from the direction of oncoming traffic. This advantageously provides enhanced illumination on the thoroughfare surface that does not have any effect on a user of the thoroughfare surface. For example, if the lighting device 100 is to be used in connection with a roadway, the lighting device may be positioned on the roadway in a manner so that light emitted from the lighting device may be directed angled away from oncoming traffic. In other words, the angle of emission of the light is configured so that a driver of a vehicle in oncoming traffic is not blinded, or otherwise effected, by the light emitted from the lighting device 100. Although it is disclosed above that the angle of emission of the light is at least one degree away from the direction of oncoming traffic, those skilled in the art will appreciate that the angle of emission of the light may preferably be between about 10 degrees and 30 degrees away from the direction of oncoming traffic. Those skilled in the art will also appreciate that the angle of emission of light may be any angle while still accomplishing the goals, features and advantages of the present invention. Further, those skilled in the art will appreciate that the angle of emission of the light is not limited to being angled away from oncoming traffic, but angled away from any use of any thoroughfare surface.

In the embodiments of the present invention, those skilled in the art will appreciate that the embodiments may be used for different purposes. For example, the lighting device 100, as illustrated in FIGS. 1-9, may be positioned along a center line of a two directional roadway. This may enable traffic to travel in both directions of the roadway and may avoid light being emitted into oncoming vehicles or traffic, thereby lighting the roadway surface and preventing drivers from being blinded by the lighting device 100.

Although not illustrated, as an additional example of an embodiment of the present invention, those skilled in the art will appreciate that the lighting device 100 may be positioned in between lanes of a roadway with traffic traveling in the same direction. This may enable traffic to travel in the same direction on the roadway and may avoid light being emitted into oncoming vehicles or traffic, thereby lighting the roadway surface and preventing drivers from being blinded by the lighting device 100.

As yet another example of an embodiment of the present invention, those skilled in the art will appreciate that the lighting device 100 may be configured in reverse so that the lighting device 100 may be positioned on thoroughfare surfaces as described herein for traffic patterns involving traffic moving forward on the left side of a road, such as in Great Britain, South Africa, and Australia.

In still another example of an embodiment of the present invention, those skilled in the art will appreciate that the lighting device 100 may be configured to emit light to illuminate structures, such as curbs and drainage structures. The lighting device 100 may be positioned on a thoroughfare surface, such as a curb, drainage structure, or other similar object. For example, the second sidewall 115 may not contain the second primary optic 121, the second optical chamber 125, or the second light source 128.

In the embodiments of the present invention, those skilled in the art will further appreciate that the emission of light from at or about the thoroughfare surface may allow the first and second light sources 127, 128 to be smaller luminaires than overhead lighting devices may otherwise require. The energy required to power the lighting device 100 may also be diminished in comparison to overhead lighting devices. The absorption of light emitted from overhead lighting devices may be about greater than 50 percent and about 80 percent of the light emitted. The lighting device 100 may have less than 50 percent light absorption due to the low angle at which light may be emitted from the first and second light sources 127, 128 relative to the thoroughfare surface(s). The angle at which the light may be emitted from the first and second light sources 127, 128 relative to the thoroughfare surface(s) may be about slightly less than parallel with the thoroughfare surface in a downward direction and may be upwards as much as about 90 degrees or about perpendicular from the thoroughfare surface. The light absorbed by the thoroughfare surface may be about 1 percent to about 100 percent, but those skilled in the art will appreciate that the amount of light emitted by the first and second light sources 127, 128 that is absorbed by the thoroughfare surface may preferably be between about 10 percent and 50 percent.

The second sidewall 115 may taper in a direction of the proximal face 112 or the distal face 113. The second primary optic 121 may direct light outward and in the direction of the taper in the second sidewall 115. For example, the second primary optic 120 may direct light outward and in a direction of the proximal face 112 or the distal face 113 so as to avoid emitting light in a direction of oncoming traffic. The light emitted may be directed so that it is angled at least one degree away from the direction of oncoming traffic.

Light emitted from the first light source 127 may be directed through the first primary optic 120 within a range from about parallel to a face of the first primary optic 120 in the direction of the proximal face 112 or the distal face 113 to skew from the face of the first primary optic 120 to about perpendicular to the face of the first primary optic 120. Those skilled in the art will readily appreciate that light emitted from the first light source 127 may be directed in any number of angles, directions, or combinations within the range described herein, and that the range described above is exemplary, and not meant to be limiting in any way.

Light emitted from the second light source 128 may be directed through the second primary optic 121 within a range from about parallel to a face of the second primary optic 121 in the direction of the proximal face 112 or the distal face 113 to skew from the face of the second primary optic 121 to about perpendicular to the face of the second primary optic 121. Those skilled in the art will readily appreciate that light emitted from the second light source 128 may be directed in any number of angles, directions, or combinations within the range described herein, and that the range described above is an exemplary configuration, and not meant to be limiting in any way.

The first and second primary optics 120, 121 and/or the first and second secondary optics 124, 125 may interact with light emitted by the first and second light sources 127, 128 to refract, reflect, collimate, diffuse, direct, and/or otherwise redirect incident light. Accordingly, the first and second light sources 127, 128 may be disposed such that light emitted therefrom is incident upon the first and second primary optics 120, 121 and/or the first and second secondary optics 124, 125. The first and second primary optics 120, 121 and/or the first and second secondary optics 124, 125 may be formed in any shape to impart a desired refraction. In the present embodiment, the first and second primary optics 120, 121 have a generally flat, but prismatic geometry. Additionally, in the present embodiment, the first and second secondary optics 124, 125 have a generally flat geometry.

Furthermore, the lighting device 100 may include multiple optics. The first and second primary optics 120, 121 and/or the first and second secondary optics 124, 125 may be formed of any transparent, translucent, or substantially translucent material that comports with the desired refraction including, but not limited to, glass, fluorite, and polymers, such as polycarbonate. Types of glass include, without limitation, fused quartz, soda-lime glass, lead glass, flint glass, fluoride glass, aluminosilicates, phosphate glass, borate glass, and chalcogenide glass.

Referring to FIGS. 2A and 2B, the first and second primary optics 120, 121 and/or the first and second secondary optics 124, 125 may be prismatic optics and may refract light substantially about the first and second light sources 127, 128, resulting in approximately omni-directional and uniform light distribution. FIG. 2A depicts one side of the lighting device 100 according to an embodiment of the present invention, while FIG. 2B depicts an opposing side of the lighting device 100 according to an embodiment of the present invention. Those skilled in the art will appreciate that, as is evident in the FIGS. 2A and 2B, this embodiment of the lighting device 100 according to the present invention is somewhat symmetrical in nature. The first and second primary optics 120, 121 and/or the first and second secondary optics 124, 125 may include inner surfaces that may include a plurality of generally vertical segments and a plurality of generally horizontal segments. Each of the generally vertical segments may have two ends and may be attached at each end to a generally horizontal segment, thereby forming a plurality of prismatic surfaces. It is not a requirement of the invention that the generally vertical segments be perfectly vertical, nor is it a requirement that the generally horizontal segments be perfectly horizontal. Similarly, it is not a requirement of the invention that the generally vertical segments be perpendicular to the generally horizontal segments. Each of the prismatic surfaces may be smooth, having a generally low surface tolerance. Moreover, each of the prismatic surfaces may be curved, forming a diameter of the inner surfaces.

The variance of the generally vertical segments from vertical may be controlled and configured to desirously refract light. Similarly, the variance of the generally horizontal segments from horizontal may be controlled and configured to produce prismatic surfaces that desirously refract light. Accordingly, the prismatic surfaces may desirously refract light outward from the lighting device 100 and may be configured to selectively refract light within desired ranges about the lighting device 100 as described herein. Additional details relating to prismatic optics incorporated into a lighting device are provided in U.S. patent application Ser. No. 13/739,054 titled Luminaire with Prismatic Optic filed Jan. 11, 2013 which, in turn, claims the benefit under 35 U.S.C. §119(e) of U.S. Provisional Patent Application Ser. No. 61/642,205 titled Luminaire with Prismatic Optic filed May 3, 2012, the entire contents of each of which are incorporated by reference.

Figure 1B:
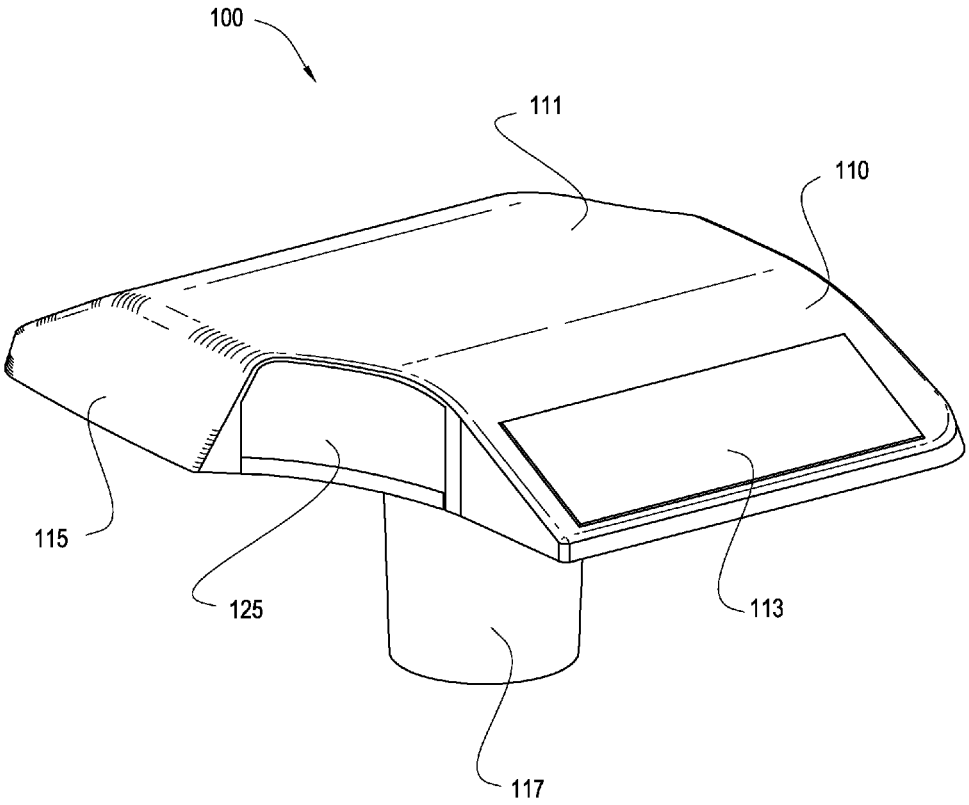
FIG. 1B is left side perspective view of the lighting device illustrated in FIG. 1A.
Figure 3A:
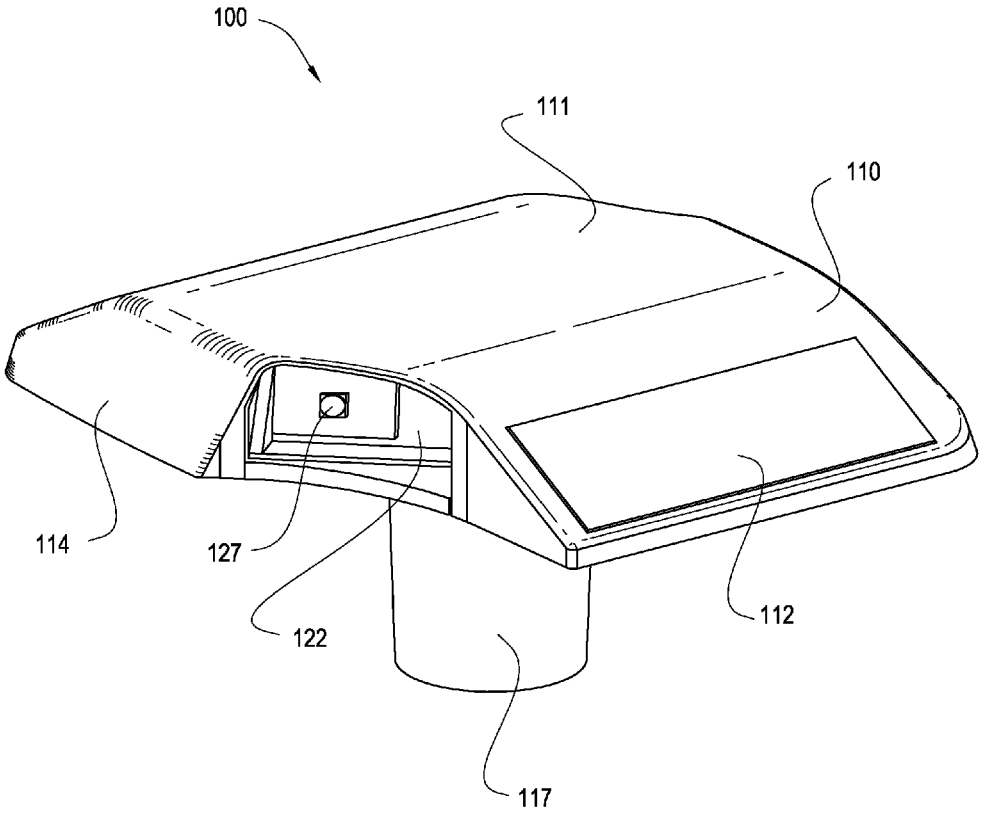
FIG. 3A is a right side perspective view of a portion of the lighting device illustrated in FIG. 1A.
Figure 3B:
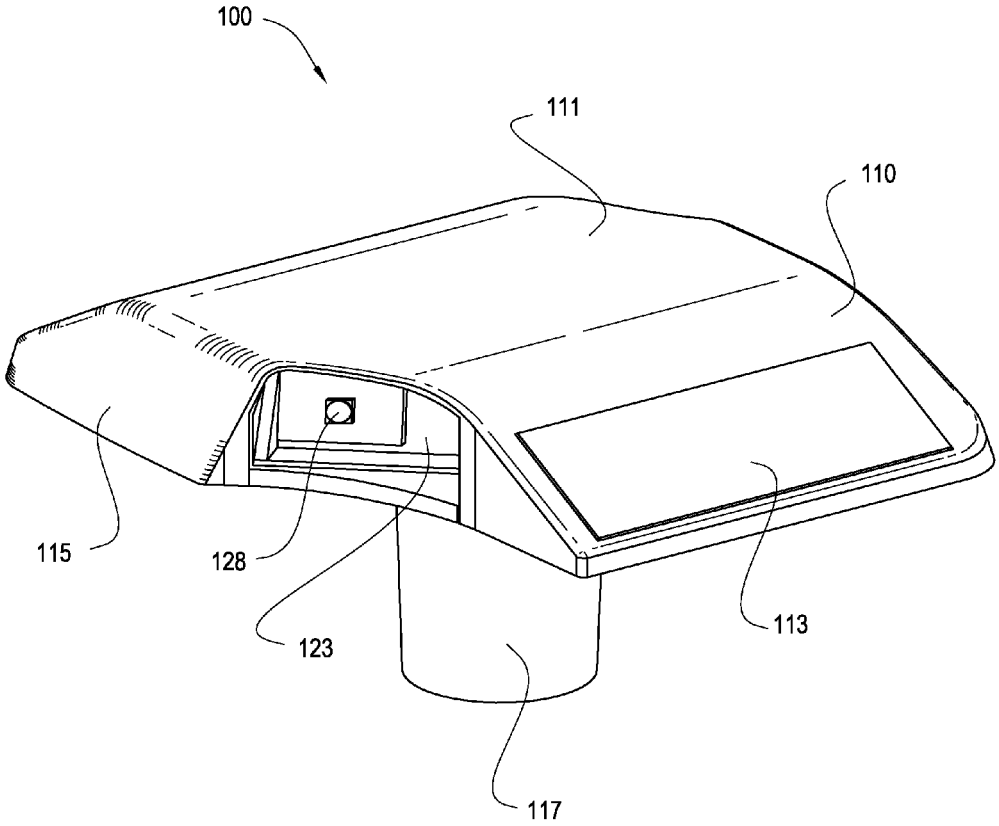
FIG. 3B is a left side perspective view of a portion of the lighting device illustrated in FIG. 1A.
Figure 4:
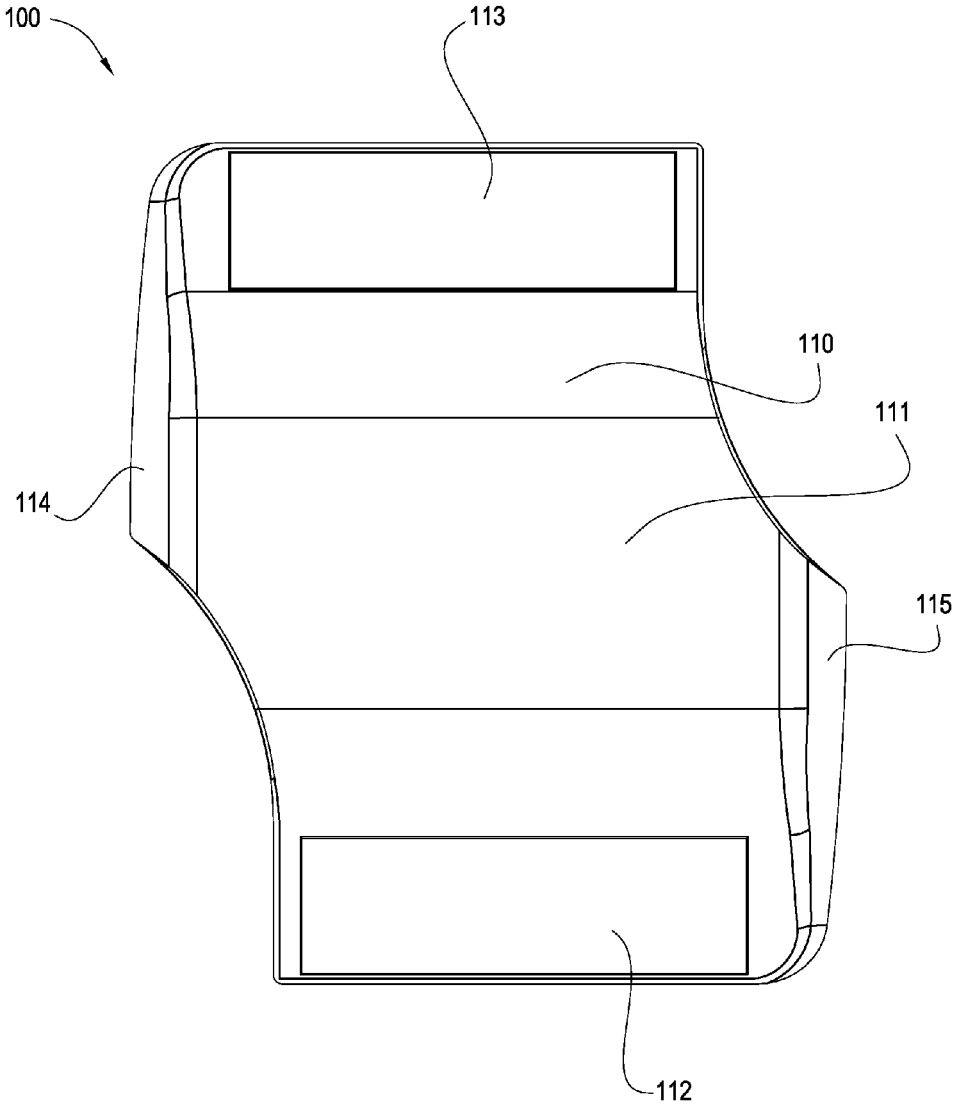
FIG. 4 is a top plan view of the lighting device illustrated in FIG. 1A.
Figure 5:
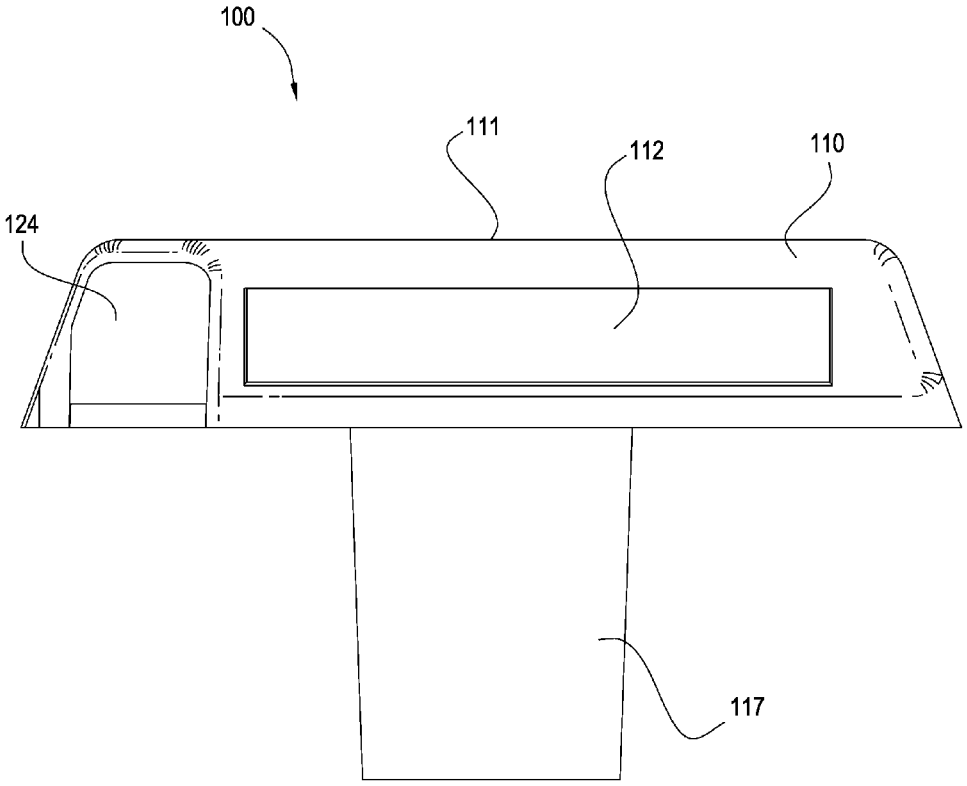
FIG. 5 is a front elevation view of the lighting device illustrated in FIG. 1A.
Figure 6:
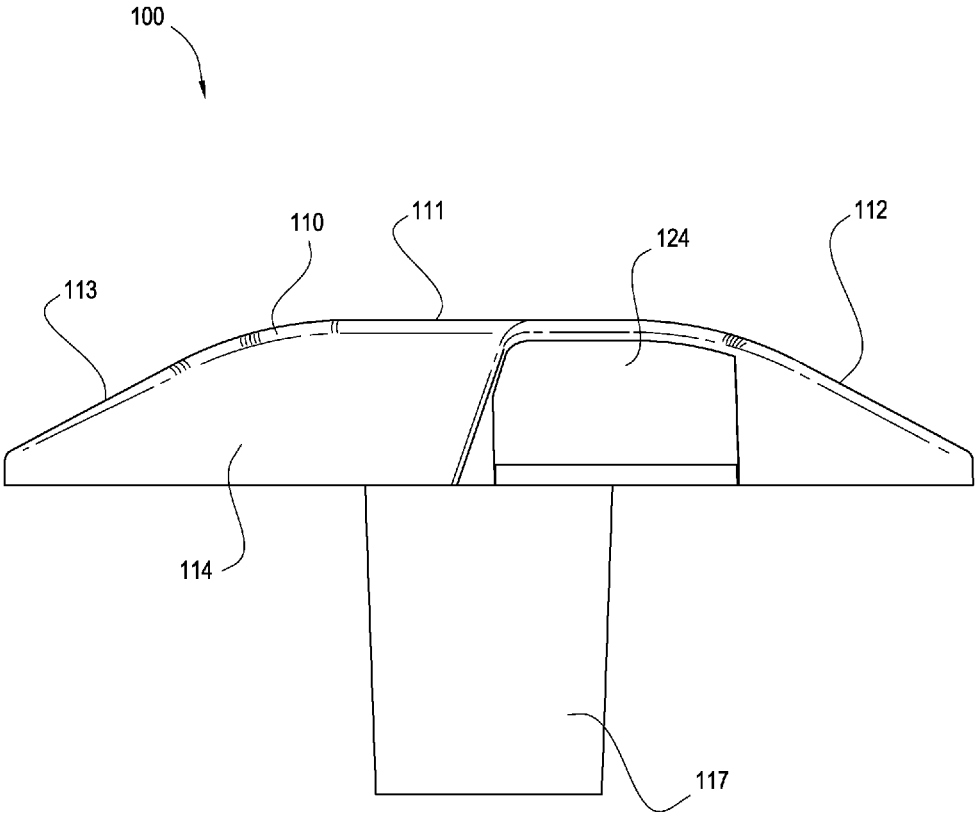
FIG. 6 is a side elevation view of the lighting device illustrated in FIG. 1A.

Referring to FIGS. 1A, 1B, 3A, and 3B, similar to the description above of FIGS. 2A and 2B, FIG. 1A depicts one side of the lighting device 100 according to an embodiment of the present invention, while FIG. 1B depicts an opposing side of the lighting device 100 according to an embodiment of the present invention. Additionally, FIG. 3A depicts one side of the lighting device 100 according to an embodiment of the present invention, while FIG. 3B depicts an opposing side of the lighting device 100 according to an embodiment of the present invention. Those skilled in the art will appreciate that, as is evident in the FIGS. 1A and 1B, as well as FIGS. 3A and 3B, this embodiment of the lighting device 100 according to the present invention is somewhat symmetrical in nature.

Referring again to FIGS. 1-9, in order to maintain a fluid seal between the first and second primary optics 120, 121 and the first and second optical chambers 122, 123, and/or the environment external to the lighting device 100, the first and second primary optics 120, 121 may further include a sealing member. The sealing member may include any device or material that can provide a fluid seal as described above. For example, and without limitation, the sealing member may form a fluid seal between the first and second primary optics 120, 121 and the housing 110. In order to maintain a fluid seal between the first and second secondary optics 124, 125 and the environment external to the lighting device 100, the first and second secondary optics 124, 125 may further include a sealing member. The sealing member may include any device or material that can provide a fluid seal as described above. For example, and without limitation, the sealing member may form a fluid seal between the first and second secondary optics 124, 125 and the housing 110.

The first and second light sources 127, 128 may include any device capable of emitting light. The first and second light sources 127, 128 may, for example and without limitation, include incandescent lights, halogens, fluorescents (including compact-fluorescents), high-intensity discharges, light emitting semiconductors, such as light-emitting diodes (LEDs), lasers, and any other light-emitting device known in the art. In some embodiments of the present invention, the first and second light sources 127, 128 are each an LED package. In some further embodiments, the LED package may include a plurality of LEDs and a circuit board.

Furthermore, those skilled in the art will readily appreciate that additional embodiments with different configurations, including opposite configurations, are described herein, and the configurations above are exemplary, and not meant to be limiting in any way.

Although it is preferable for the light from the first and second light sources 127, 128 to be emitted in a generally outward direction along adjoining surfaces, i.e., in a direction opposite the opposing sidewall and perpendicular to the face of the first and second primary optics 120, 121, those skilled in the art will appreciate that the light may shine outwardly from the first and second light sources 127, 128 in any direction through various openings and optics. This may advantageously allow for the lighting device 100 according to embodiments of the present invention to provide various lighting effects that may be desirable to a user.

Figure 10:
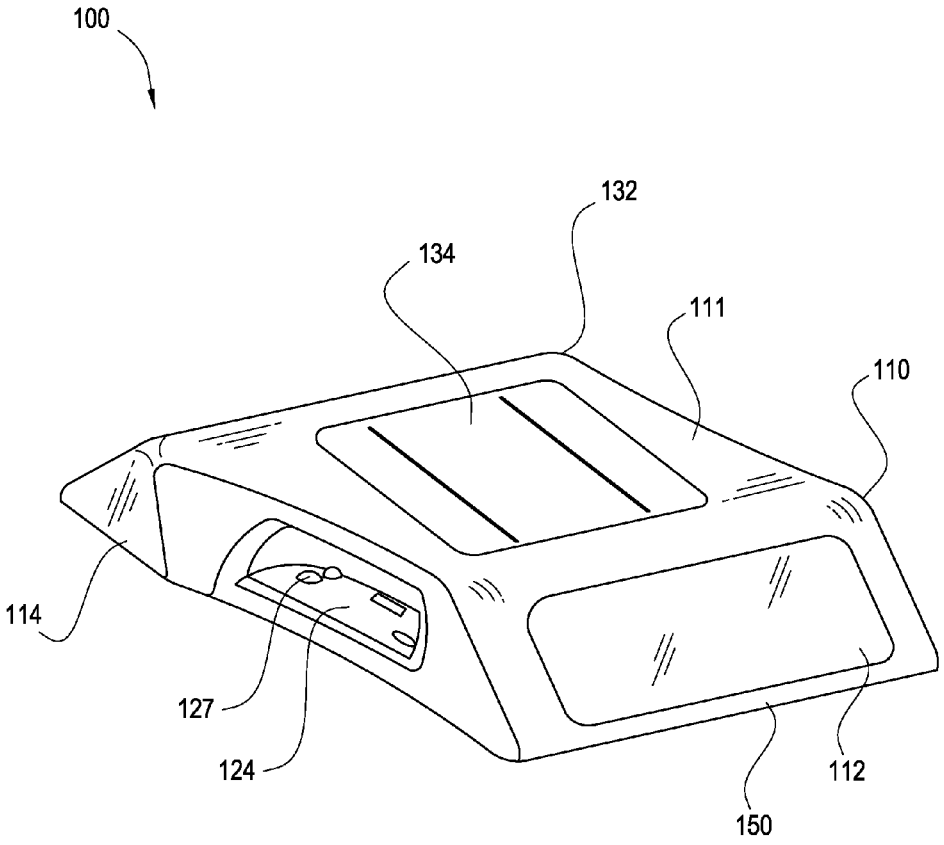
FIG. 10 is a perspective view of a lighting device according to another embodiment of the present invention.

Referring now to FIGS. 9-11, the ambient light sensor 130 may be a photodiode device, a phototransistor device, a photovoltaic device, or a photomultiplier device. The power generating device 131 may be a photovoltaic device, piezoelectric device, or a thermoelectric device. The ambient light sensor 130 may be configured to dim the first and second light sources 127, 128. Further, the first and second light sources 127, 128 may also be configured to turn on or off depending on the amount of traffic or as desired by a user.

The driver circuit 141 may be electrically coupled to the power generating element 131, the first and second light sources 127, 128, the circuitry 140, the microcontroller 142, and/or the battery 145. The battery 145 may be electrically coupled to the power generating element 131, the photovoltaic device 132, the circuitry 140, the driver circuit 141, the microcontroller 142, the communication device 143, and/or the traffic sensor 144. Those skilled in the art will recognize that any of these components may be electrically coupled to each other in any combination known in the art. The power generating element 131 and/or the photovoltaic device 132 may produce electrical power that may be stored by the battery 145. The first and second light sources 127, 128 and/or the microcontroller 142 may operate using electrical power that may be drawn from the circuitry 140, the driver circuit 141, and/or the battery 145. Additionally, the external power source may be electrically coupled to the power generating element 131, the photovoltaic device 132, the circuitry 140, the driver circuit 141, the microcontroller 142, the communication device 143, and/or the traffic sensor 144, and the battery 145. For example and without limitation, the external power source may be an electrical line provided below the thoroughfare surface or through the ground and may be electrically coupled to the driver circuit 141 through the post 117.

The traffic sensor 144 may generate data regarding traffic in the environment that may be surrounding the lighting device 100. The communication device 143 may transmit the data generated by the traffic sensor 144 across a network. The communication device 143 may be a wireless communication device. The communication device 143 may be a radio device, a computer network device, a visible light device, an acoustic device, or any other device known in the art that provides wireless communication. Those skilled in the art will appreciate that a communication device 143 being incorporated into the lighting device 100 advantageously allows for the lighting device 100 to be remotely operated and/or monitored, if so desired by a user. Those skilled in the art will further appreciate that the communication device 143 also advantageously allows for the lighting device 100 to communicate data through a remote connection, such as the network, if so desired by a user. Additional details relating to communication devices incorporated into a lighting device are provided in U.S. patent application Ser. No. 12/145,634 titled Configurable Environmental Condition Sensing Luminaire System and Associated Methods filed on Feb. 23, 2012, which, in turn, claims the benefit of U.S. Provisional Patent Application Ser. No. 61/486,316 titled Motion Detecting Security Light and Associated Methods filed on May 15, 2011, as well as U.S. Provisional Patent Application Ser. No. 61/486,314 titled Wireless Lighting Device and Associated Methods filed on May 15, 2011, and U.S. Provisional Patent Application Ser. No. 61/486,322 titled Variable Load Power Supply filed on May 15, 2011, the entire contents of each of which are incorporated by reference.

Referring to FIGS. 1-9, the first and second opposing sidewalls 114, 115 may be curved, slanted, partially curved, and/or partially slanted. For example, the first sidewall 114 may extend straight from the proximal face 112 toward the distal face 113, then taper in a direction toward the second sidewall 115, then reverse direction at the same angle to extend directly straight again toward the distal face 113.

The reflective member 150 may be positioned on the proximal face 112 and/or the distal face 113. As perhaps best illustrated in FIGS. 7 and 8, the heat sink 160 may be carried by the housing 110 and may include a plurality of fins 161. Those skilled in the art will appreciate that there may be any number of fins 161 which may be positioned on any number of surfaces of the housing 110, including the top surface 111, the proximal face 112, the distal face 113, the first and second opposing sidewalls 114, 115, and/or the heat sink 160. The bottom member 116 and/or the post 117 may include the heat sink 160. Additionally, the lighting device 100 may include one or more heat sinks 160. The first and second light sources 127, 128 may emit light which may produce heat. The heat sink 160 may provide surface area to allow heat to travel away from the first and second light sources 127, 128, thereby cooling the first and second light sources 127, 128. Removing heat from the first and second light sources 127, 128 may enhance the life of the first and second light sources 127, 128 and the lighting device 100 in general. For example, the post 117 may be the heat sink 160 and may transfer heat away from the lighting device 100 through the thoroughfare surface, structure, ground, or other similar object.

Figure 7:
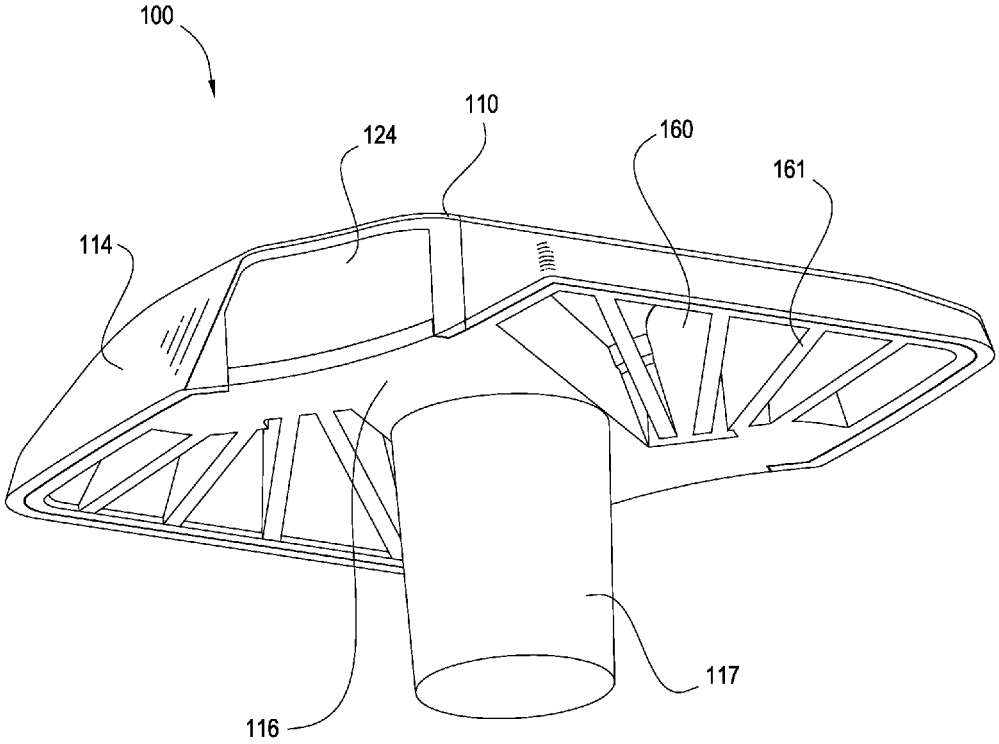
FIG. 7 is a bottom perspective view of the lighting device illustrated in FIG. 1A.
Figure 8:
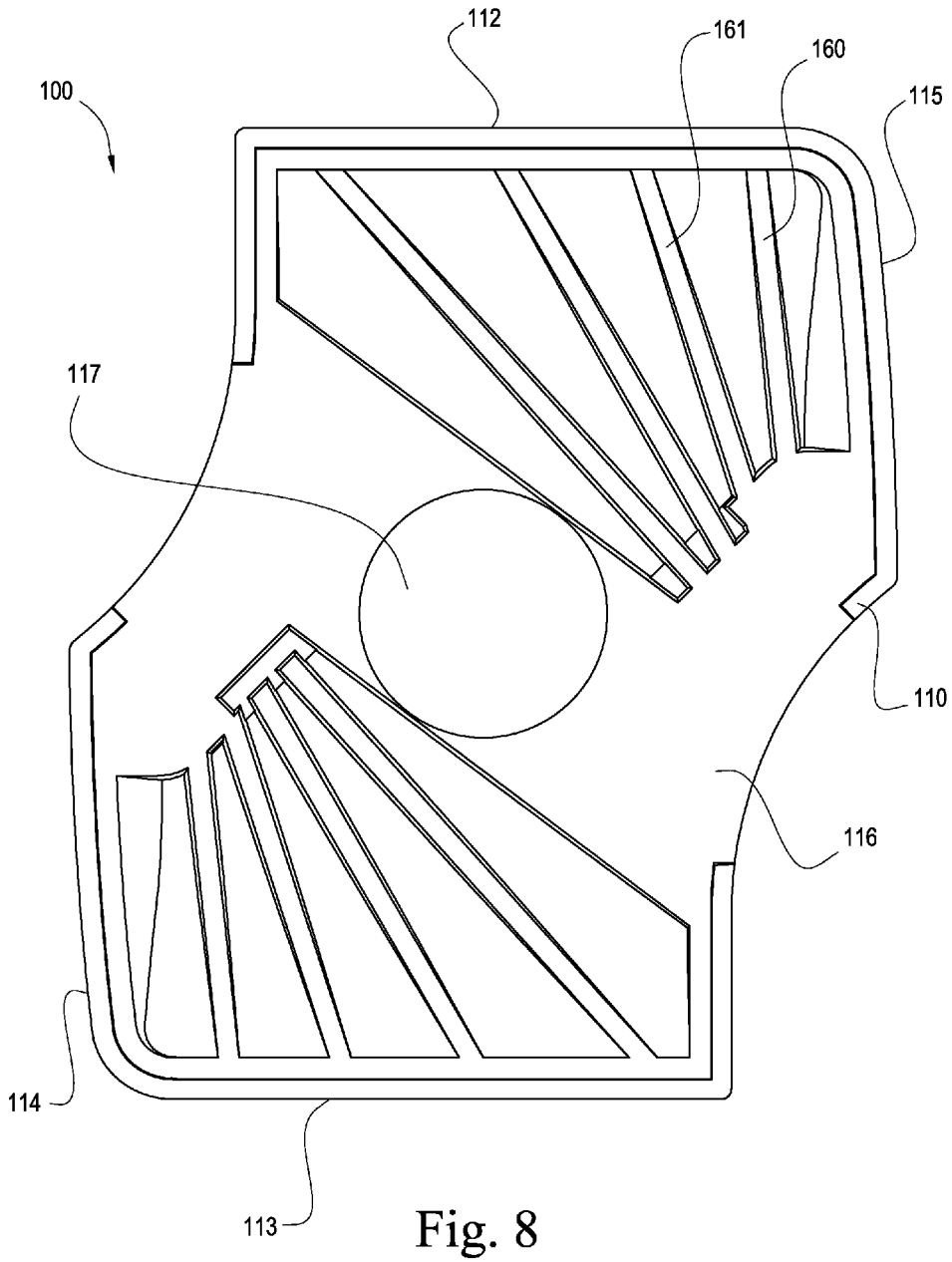
FIG. 8 is a bottom plan view of the lighting device illustrated in FIG. 1A.

Continuing to refer to FIGS. 7-8, the heat sink 160 may be configured to extend substantially the length of the housing 110 and the plurality of fins 161 may be configured to extend substantially the length of the heat sink 160. Those skilled in the art will appreciate that the present invention contemplates the use of the plurality of fins 161 that extend any distance and may project radially outward from the heat sink 160, and that the disclosed heat sink 160 that includes the plurality of fins 161 that extend substantially the length thereof is not meant to be limiting in any way. The plurality of fins 161 may increase the surface area of the heat sink 160 and may permit thermal fluid flow between each fin 161, thereby enhancing the cooling capability of the heat sink 160. The heat sink 160 and/or the plurality of fins 161 may provide support for the housing 110. Additional details and information regarding the cooling function of heat sinks with respect to lighting devices are provided in U.S. Provisional Patent Application Ser. No. 61/715,075 titled Lighting Device with Integrally Molded Cooling System and Associated Methods filed on Oct. 17, 2012.

Referring primarily to FIGS. 3A, 3B, 5-9, and 11, for example, and without limitation, the post 117 may be formed into any tubular shape, including a circle, ovoid, square, rectangle, triangle, or any other polygon and can be solid, hollow, or a combination of the two. The post 117 may be substantially hollow to form a chamber. The chamber may carry the circuitry 140 and/or the battery 145. Although the circuitry 140 is shown in FIG. 9, for the sake of clarity, one embodiment of a plurality of components of the circuitry 140 and the power generating element 131 is shown schematically drawn in FIG. 11 with the lines indicating merely that the component is electrically connected to another component, and not necessarily indicating the location of the components. The chamber may present a void of sufficient geometry to permit electrical connectors, such as wires, to pass therethrough from the first and second light sources 127, 128 to the circuitry 140. In order to maintain a fluid seal between the chamber and the environment external to the lighting device 100, the post 117 may further include a sealing member. The sealing member may include any device or material that can provide a fluid seal as described above. For example, and without limitation, the sealing member may form a fluid seal between the bottom member 116 and the post 117. Other embodiments may have the chamber disposed on other parts of a cooling system and the housing 110.

Referring again to FIGS. 1-9, also for example, and without limitation, the housing 110 and components of the housing 110, including the top surface 111, the proximal face 112, the distal face 113, the first and second opposing sidewalls 114, 115, the bottom member 116, and/or the post 117 may be molded or overmolded, which may be individually and separately, and which may be accomplished by any molding process known in the art, including, but not limited to blow molding, sintering, compression molding, extrusion molding, injection molding, matrix molding, transfer molding, or thermoforming. The housing 110 and components of the housing 110, including the top surface 111, the proximal face 112, the distal face 113, the first and second opposing sidewalls 114, 115, the bottom member 116, and/or the post 117 may be attached by glue, adhesives, fasteners, screws, bolts, welding, or any other means known in the art.

Additionally, and without limitation, the housing 110 and components of the housing 110, including the top surface 111, the proximal face 112, the distal face 113, the first and second opposing sidewalls 114, 115, the bottom member 116, and/or the post 117 may be provided by a material having a thermal conductivity=150 Watts per meter-Kelvin, a material having a thermal conductivity=200 Watts per meter-Kelvin, an aluminum, an aluminum alloy, a magnesium alloy, a metal loaded plastics material, a carbon loaded plastics material, a thermally conducting ceramic material, an aluminum silicon carbide material, a plastic, and/or other similar materials known in the art. Furthermore, the material may be any material that allows the dissipation of heat.

The lighting device 100 may further include a tilting mechanism. The tilting mechanism may be positioned within the housing 110 or the post 117 and may be electrically coupled to the ambient light sensor 130, the power generating element 131, the photovoltaic device 132, the circuitry 140, the driver circuit 141, the microcontroller 142, the communication device 143, the traffic sensor 144, and/or the battery 145.

Referring now to FIG. 10, another embodiment of the present invention is shown. In this embodiment of the present invention, the lighting device 100 may include a housing 110. The housing 110 may include a top surface 111, a proximal face 112, a first sidewall 114, a first optical chamber 122, a photovoltaic device 132, a top inner surface 133, a photovoltaic device chamber 134, and a reflective member 150. The first optical chamber 122 may include the first secondary optic 124, the reflective layer 126, and the first light source 127. Although not illustrated in FIG. 10, the housing may further include a distal face 113, a second sidewall 115, and a second optical chamber 123. The second optical chamber 123 may include the second secondary optic 125, the reflective layer 126, and the second light source 128.

The proximal face 112 may be positioned on the reflective member 150. The top surface 111 may include the photovoltaic device chamber 134. The photovoltaic device 132 may be positioned in the photovoltaic chamber 134. Additionally, the photovoltaic device 132 may be tiltable within the photovoltaic device chamber 134. For example, a proximal end of the photovoltaic device 132 may tilt in a downward direction, thereby causing the distal end of the photovoltaic device 132 to tilt in an upward direction. As an additional example, the proximal end of the photovoltaic device 132 may tilt in an upward direction, thereby causing the distal end of the photovoltaic device 132 to tilt in a downward direction. The photovoltaic device 132 may tilt so that the optimal amount of solar energy may be obtained. The lighting device 100 may further include a tilting mechanism. The tilting mechanism may be electrically coupled to the photovoltaic device 132 and may produce the desired tilt in the photovoltaic device 132. Those skilled in the art will appreciate that the embodiments of the present invention may include a photovoltaic device 132 that is stationary or that tilts in any number of directions.

The top inner surface 133 of the photovoltaic device chamber 134 may be positioned above the photovoltaic device 132. In order to maintain a fluid seal between the top inner surface 133 and the environment external to the lighting device 100, the top inner surface 133 may further include a sealing member. The sealing member may include any device or material that can provide a fluid seal as described above. For example, and without limitation, the top inner surface 133 may include the sealing member that may form a fluid seal between the top inner surface 133 and the top surface 111 of the housing 110. The top inner surface 133 may be formed of any transparent, translucent, or substantially translucent material that comports with the desired refraction including, but not limited to, glass, fluorite, and polymers, such as polycarbonate. Types of glass include, without limitation, fused quartz, soda-lime glass, lead glass, flint glass, fluoride glass, aluminosilicates, phosphate glass, borate glass, and chalcogenide glass.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims.

Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item. Additionally, the term "and" should be construed to include the term "or" if possible as the term "and" is not for purposes of limitation. Thus, the scope of the invention should be determined by the appended claims and their legal equivalents, and not by the examples given.

What is claimed is:

1. A lighting device comprising:

a housing configured to be attached to a thoroughfare surface, the housing having a top surface, a proximal face, a distal face, and first and second opposing sidewalls extending between the proximal face and the distal face and extending downwardly from the top surface;

a first primary optic carried by the housing adjacent the first sidewall to define a first optical chamber wherein the first primary optic is positioned generally facing away from the proximal face and at least one degree away from oncoming traffic; and a first light source positioned within the first optical chamber and carried by the housing adjacent the first sidewall;

wherein the first sidewall tapers in a direction of the distal face; and wherein the first primary optic is configured to direct light outward and in a direction of the taper in the first sidewall and generally in a direction of the thoroughfare surface.

2. A lighting device according to claim 1 wherein light emitted from the first light source is directed through the first primary optic within a range from about parallel to a face of the first primary optic in the direction of the proximal face to skew from the face of the first primary optic to about perpendicular to the face of the first primary optic.

3. A lighting device according to claim 1 further comprising:

a second primary optic carried by the housing adjacent the second sidewall to define a second optical chamber; and a second light source positioned within the second optical chamber and carried by the housing adjacent the second sidewall;

wherein the second sidewall tapers in a direction of one of the proximal face and the distal face; and wherein the second primary optic is configured to direct light outward and in the direction of the taper in the second sidewall.

4. A lighting device according to claim 3 wherein light emitted from the second light source is directed through the second primary optic within a range from about parallel to a face of the second primary optic in the direction of at least one of the proximal face and the distal face to skew from the face of the second primary optic to about perpendicular to the face of the second primary optic.

5. A lighting device according to claim 1 further comprising at least one of a first and second secondary optic carried by the housing.

6. A lighting device according to claim 1 further comprising an ambient light sensor carried by the housing.

7. A lighting device according to claim 6 wherein the ambient light sensor is at least one of a photodiode device, a phototransistor device, a photovoltaic device, and a photomultiplier device.

8. A lighting device according to claim 1 further comprising a power generating element carried by the housing and being at least one of a photovoltaic device, a piezoelectric device, and a thermoelectric device.

9. A lighting device according to claim 8 further comprising:

a driver circuit electrically coupled to the power generating element, the first light source, and a microcontroller; and a battery electrically coupled to the power generating element;

wherein the power generating element is configured to produce electrical power that is stored by the battery; and wherein at least one of the first light source and the microcontroller are configured to operate using electrical power drawn from the driver circuit.

10. A lighting device according to claim 1 comprises a photovoltaic device; and wherein the housing further comprises a top inner surface cooperating with the photovoltaic device to define a photovoltaic device chamber.

11. A lighting device according to claim 1 wherein the driver circuit is electrically coupled to an external power source.

12. A lighting device according to claim 1 wherein at least one of the first and second opposing sidewalls is at least one of curved, slanted, partially curved, and partially slanted.

13. A lighting device according to claim 1 wherein the first optical chamber comprises a reflective layer.

14. A lighting device according to claim 13 wherein the reflective layer is a color-converting reflective layer.

15. A lighting device according to claim 1 wherein the first primary optic comprises a color-converting layer.

16. A lighting device according to claim 1 further comprising:

a communication device;

a microcontroller; and a traffic sensor;

wherein the traffic sensor is configured to generate data regarding traffic in the environment surrounding the lighting device; and wherein the communication device is configured to transmit the data generated by the traffic sensor across a network.

17. A lighting device according to claim 1 wherein the first light source comprises a light emitting diode (LED).

18. A lighting device according to claim 1 wherein the first primary optic is configured to at least one of collimate, diffuse, direct, and refract light.

19. A lighting device according to claim 1 further comprising a reflective member that is positioned on at least one of the proximal face and the distal face.

20. A lighting device according to claim 1 further comprising a heat sink carried by the housing and comprising a plurality of fins.

21. A lighting device according to claim 1 further comprising a post carried by at least one of the housing and a bottom member wherein the post comprises at least one of a heat sink, a battery, and a circuitry.

22. A lighting device comprising:

a housing configured to be attached to a thoroughfare surface, the housing having a top surface, a proximal face, a distal face, and first and second opposing sidewalls extending between the proximal face and the distal face and extending downwardly from the top surface;

a first primary optic carried by the housing adjacent the first sidewall to define a first optical chamber wherein the first primary optic is positioned generally facing away from the proximal face and at least one degree away from oncoming traffic;

a first light source positioned within the first optical chamber and carried by the housing adjacent the first sidewall;

a second primary optic carried by the housing adjacent the second sidewall to define a second optical chamber wherein the second primary optic is positioned generally facing away from the distal face; and a second light source positioned within the second optical chamber and carried by the housing adjacent the second sidewall;

wherein the first sidewall tapers in a direction of the distal face;

wherein the second sidewall tapers in a direction of the proximal face;

wherein the first primary optic is configured to direct light outward and in the direction of the taper in the first sidewall; and wherein the second primary optic is configured to direct light outward and in the direction of the taper in the second sidewall.

23. A lighting device according to claim 22 wherein light emitted from the first light source is directed through the first primary optic within a range from about parallel to a face of the first primary optic in the direction of the proximal face to skew from the face of the first primary optic to about perpendicular to the face of the first primary optic and wherein light emitted from the second light source is directed through the second primary optic within a range from about parallel to a face of the second primary optic in the direction of the distal face to skew from the face of the second primary optic to about perpendicular to the face of the second primary optic.

24. A lighting device comprising:

a housing configured to be attached to a thoroughfare surface, the housing having a top surface, a proximal face, a distal face, and first and second opposing sidewalls extending between the proximal face and the distal face and extending downwardly from the top surface;

a first primary optic carried by the housing adjacent the first sidewall to define a first optical chamber wherein the first primary optic is positioned generally facing away from the proximal face and at least one degree away from oncoming traffic;

a first light source positioned within the first optical chamber and carried by the housing adjacent the first sidewall;

a second primary optic carried by the housing adjacent the second sidewall to define a second optical chamber wherein the second primary optic is positioned generally facing away from the proximal face; and a second light source positioned within the second optical chamber and carried by the housing adjacent the second sidewall;

wherein the first sidewall tapers in a direction of the distal face;

wherein the second sidewall tapers in a direction of the distal face;

wherein the first primary optic is configured to direct light outward and in the direction of the taper in the first sidewall; and wherein the second primary optic is configured to direct light outward and in the direction of the taper in the second sidewall.

25. A lighting device according to claim 24 wherein light emitted from the first light source is directed through the first primary optic within a range from about parallel to a face of the first primary optic in the direction of the proximal face to skew from the face of the first primary optic to about perpendicular to the face of the first primary optic and wherein light emitted from the second light source is directed through the second primary optic within a range from about parallel to a face of the second primary optic in the direction of the proximal face to skew from the face of the second primary optic to about perpendicular to the face of the second primary optic.

* * * * *